US006935053B2

(12) United States Patent
Wiener

(10) Patent No.: US 6,935,053 B2
(45) Date of Patent: Aug. 30, 2005

(54) WATERPROOF FOOTWEAR AND METHODS FOR MAKING THE SAME

(75) Inventor: Robert J. Wiener, Middletown, DE (US)

(73) Assignee: Gore Enterprise Holdings, Inc., Newark, DE (US)

( * ) Notice: Subject to any disclaimer, the term of this patent is extended or adjusted under 35 U.S.C. 154(b) by 125 days.

(21) Appl. No.: 10/346,208

(22) Filed: Jan. 16, 2003

(65) Prior Publication Data

US 2004/0139628 A1 Jul. 22, 2004

(51) Int. Cl.[7] ..... A43B 23/07
(52) U.S. Cl. ..... 36/14; 36/55
(58) Field of Search ..... 36/55, 14, 12

(56) References Cited

U.S. PATENT DOCUMENTS 4,599,810 A 7/1986 Sacre ..... 36/55
4,819,345 A 4/1989 Mulcahy et al. ..... 36/17
4,899,465 A 2/1990 Bleimhofer et al. ..... 36/14
5,289,644 A 3/1994 Driskill et al. ..... 36/14
5,329,807 A 7/1994 Sugar et al. ..... 73/40
RE34,890 E * 4/1995 Sacre ..... 36/55
5,659,914 A 8/1997 Steinlauf ..... 12/145
5,685,091 A 11/1997 Yalamanchili ..... 36/55
5,746,012 A 5/1998 Caletti et al. ..... 36/3 B
6,446,360 B1 * 9/2002 Sheets et al. ..... 36/55

* cited by examiner

*Primary Examiner*—Ted Kavanaugh
(74) *Attorney, Agent, or Firm*—Kevin J. Boland

(57) ABSTRACT

Waterproof footwear and methods for making the same. The footwear includes a laminate liner material including at least a waterproof, water vapor permeable functional layer. The method includes two lasting steps to produce waterproof footwear that is durable and aesthetically pleasing.

12 Claims, 4 Drawing Sheets

WATERPROOF FOOTWEAR AND METHODS FOR MAKING THE SAME

BACKGROUND OF THE INVENTION

1. Field of the Invention

The present invention relates to waterproof footwear and methods for making the same.

2. Description of Related Art

The art is replete with attempts at making waterproof, breathable footwear. Early attempts for making such footwear included making footwear consisting of upper materials such as leather treated to make it water resistant and soles made of rubber. Thus, some breathability was achieved. However, several problems arose with this type of footwear construction. If the upper material was to be made truly waterproof, it would lose its ability to breath. Moreover, the connecting region between the waterproof sole and the upper became a major source of leakage as there was no effective way to make the connecting region waterproof.

An alternative approach to the goal of achieving comfortable waterproof footwear involved employing a waterproof insert or bootie into the shoe. This waterproof insert, if constructed of appropriate materials had the additional advantage of being permeable to water vapor so that there was no buildup of water vapor within the shoe over the time when the shoe was being worn. In the footwear art materials which are both waterproof and water vapor permeable are commonly referred to as "functional" materials. Exemplary of such a functional material is a microporous, expanded polytetrafluoroethylene membrane material available from W. L. Gore and Associates, Inc., Elkton, Md., under the tradename GORE-TEX®. Other functional materials have also been developed and are well known in the art.

Further approaches have included securing, by a lasting process, a waterproof, breathable liner material to the inside of the footwear upper and sealing the liner material to a waterproof gasket or insole. There have been many different attempts at providing a durable, waterproof seal or connection at the region where the liner material is joined with the waterproof gasket or insole. These attempts have resulted in varying degrees of success.

One problem which often results when forming such waterproof, breathable footwear is that the insertion of the liner or bootie will often result in a poor fitting shoe (i.e., a smaller fit due to the liner being inserted into the already sized shoe upper) and/or poor attachment between the liner or bootie and the shoe upper material, which results in, among other things, a less than desirable appearance of the inside of the footwear (i.e., the liner appears wrinkled or pulls away from the upper).

Thus, the search continues for durably sealed, waterproof, breathable footwear.

SUMMARY OF THE INVENTION

The invention relates to waterproof footwear and methods for making the same.

The footwear comprises:

a laminate liner material including at least a waterproof, water vapor permeable functional layer with an open top portion secured to a collar portion of an upper material, and a bottom perimeter edge portion secured to a first insole material;

a waterproof gasket material having a top surface and a bottom surface with the top surface adhered to and covering the first insole material and at least a portion of the bottom perimeter edge portion of the laminate liner material;

a second insole material secured to a perimeter edge portion of the upper material, forming a closed upper; and wherein the bottom surface of the waterproof gasket material contacts at least a portion of the second insole material.

The method comprises the steps of:

providing a laminate liner material including at least a waterproof, water vapor permeable functional layer with an open top portion and an open bottom portion;

securing a first insole material to the open bottom portion of the laminate liner material to form a bootie;

locating a shoe last within the bootie to form a bottom portion of the bootie which includes the first insole material and a perimeter edge portion of the laminate liner material;

providing a waterproof gasket material having a top surface and a bottom surface;

adhering the top surface of the waterproof gasket material to the bottom portion of the bootie, the waterproof gasket material covering the first insole material and at least a portion of the perimeter edge portion of the laminate liner material to form a waterproof bootie;

securing the open top portion of the waterproof bootie to a collar portion of a shoe upper having a perimeter edge portion; securing the perimeter edge portion of the shoe upper to a second insole material, to form a closed upper; and locating the bootie inside the closed upper such that the bottom surface of the waterproof gasket material contacts at least a portion of the second insole material.

DESCRIPTION OF THE DRAWINGS

The operation of the present invention should become apparent from the following description when considered in conjunction with the accompanying drawings, in which.

DETAILED DESCRIPTION OF THE INVENTION

The invention relates to waterproof footwear and methods for making the same. The method includes two separate lasting steps, which results in an exceptionally good fit between the laminate liner material and the shoe upper, thus resulting in, among other things, aesthetically pleasing, better fitting footwear.

The invention can best be understood with reference to the figures which illustrate preferred embodiments according to the invention.

Figure 1:
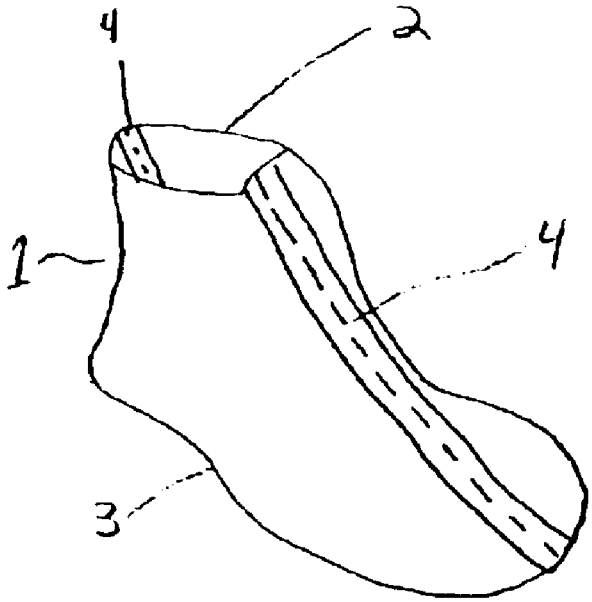
FIG. 1 is perspective view of a laminate liner material, having an open top portion and an open bottom portion.

Turning to FIG. 1 there is shown a laminate liner material 1 having an open top portion 2 and an open bottom portion 3. Also shown are optional seams 4 where two panels of laminate liner material may be joined together to form the laminate liner material 1 into the general corresponding shape of a shoe upper. Pieces of laminate liner material can be joined together by sewing, welding, gluing, etc. When pieces of laminate liner are sewn together, the seams can be made waterproof by sealing the seams 4 with known sealing materials, such as GORE-SEAM® tape (available from W. L. Gore and Associates, Inc.). Other sealants may be applied to the seams to render them waterproof if they are not inherently waterproof due to welding or gluing. The laminate liner material 1 includes at least one layer of material which is waterproof and water vapor permeable (i.e., a functional material), such as a breathable polymeric membrane. As used herein, "water vapor permeable" and "breathable" are used interchangeably and mean that the functional layer has a water vapor coefficient Ret of less than 200 $m^2$ Pa $W^{-1}$. The water vapor permeability is tested by the Hohenstein skin model. This method is described in DIN EN 31092 (02/94) or ISO 11092 (19/33). Breathable polymeric membranes may be breathable by virtue of pores in the membrane or through a solution diffusion mechanism. Breathable polymeric membranes may be selected from polyurethane, polyester, polyether, polyamide, polyacrylate, copolyether ester and copolyether amides. In an aspect of the invention the waterproof, water vapor permeable membrane is a membrane of microporous polytetrafluoroethylene. In a further aspect of the invention, the microporous polytetrafluoroethylene membrane is a membrane of expanded polytetrafluoroethylene as taught in U.S. Pat. Nos. 3,953,566 and 4,187,390, to Gore. Such membranes of expanded polytetrafluoroethylene are commercially available from W. L. Gore and Associates, Inc., Elkton, Md., under the tradename GORE-TEX® fabric. The subject matter of both of these U.S. patents is incorporated herein by reference.

The laminate liner material will contain at least the above described functional material and at least one other material laminated thereto. In this regard, the liner can include the functional material and a textile material laminated or otherwise joined to at least one side, and often times joined to both sides thereof. Lamination is generally carried out with the use of a discontinuous pattern of suitable adhesive. Thus, water vapor permeability is not significantly effected. At least one other material can be a textile fabric. Textile fabrics can be woven, knit, mesh, nonwoven, felt constructions, etc. Textiles can be produced from natural fibers such as cotton, or from synthetic fibers such as polyesters, polyamides, polypropylenes, polyolefins, or blends thereof. In an aspect of the invention a textile fabric is laminated to the side of the functional material which will be in contact with the upper material. In a further aspect of the invention a textile fabric is laminated to the side of the functional material which will face the inside of the footwear. In a still further aspect of the invention, textile fabric is laminated to both sides of the functional material, thus providing a three layer liner material.

Figure 2:
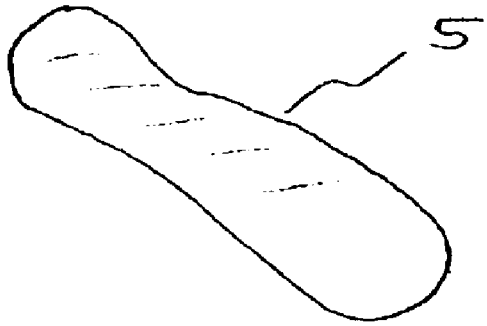
FIG. 2 is a perspective view of a first insole material.

FIG. 2 shows a first insole material 5 in the shape, generally, of the bottom of a foot. However, as will become evident, the first insole material 5 is actually somewhat smaller than the desired size of the bottom of the bootie which will be formed, as described later. The first insole material 5 can be any suitable material which is capable of being secured to the bottom portion of the laminate liner material to form a bootie. The first insole material 5 can be a woven or nonwoven material. For example, the first insole material 5 can be polyester, nylon, polyacrylic, polyolefin, polyurethane, polyvinyl, cotton, acetate, rayon, olefin, acrylic, wool, spandex, metallic, etc. For reasons which will become apparent, it is not particularly important for the first insole material 5 to be waterproof or even water resistant. The first insole material 5 can be secured to the bottom portion of the laminate liner material 1 by any suitable means. For example, the insole material 5 can be secured to the bottom portion of the laminate liner material 1 by stitching, stapling, ultra sonic welding, etc., with stitching being preferred. Upon securing the first insole material 5 to the bottom portion of laminate liner material 1, a bootie is obtained which is formed to be capable of accepting a wearer's foot.

Figure 3:
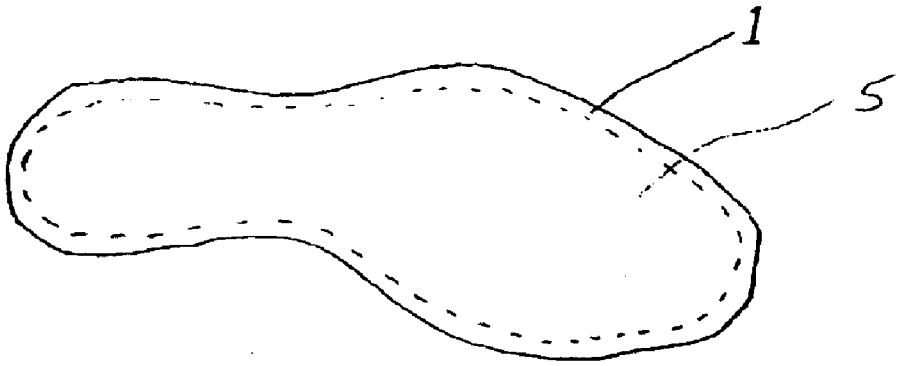
FIG. 3 is a bottom view of a bootie.

Once the bootie is formed, a first lasting process is carried out. Specifically, a shoe last is inserted into the bootie at the open top portion 2 to form the bootie to the exact shape of the shoe last. When the shoe last is inserted into the bootie, the bottom surface portion of the bootie will include the first insole material 5 and a folded over, perimeter edge portion of the laminate liner material 1, as shown in FIG. 3 . The bootie is now ready for attachment of the waterproof gasket material. Attaching the waterproof gasket to the laminate liner material 1 results in the bootie being a fixed replica of the last shape.

Figure 4:
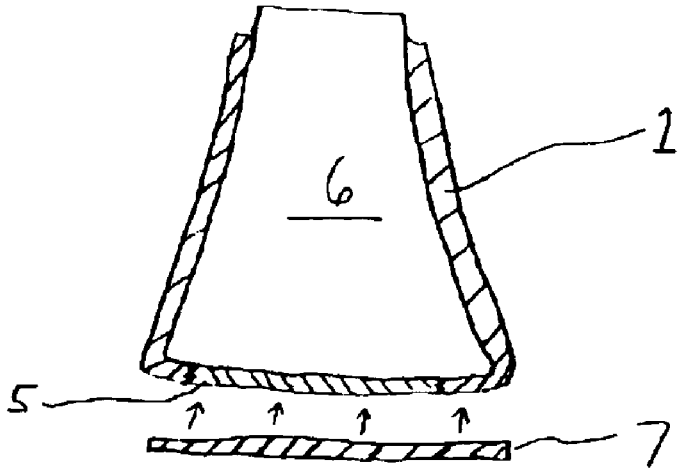
FIG. 4 is a cross-sectional view of a bootie and a waterproof gasket being applied to the bottom of the bootie.

Turning to FIG. 4, there is shown a cross-sectional view of the bootie with shoe last 6 located therein. As can be seen, a waterproof gasket material 7 having a top surface and a bottom surface is adhered to the bottom surface portion of the bootie to form a waterproof bootie. The waterproof gasket material 7 can be any suitable waterproof material. For example, polymeric materials, waterproof fabrics (either woven or non-woven), and fabrics coated with polymer are suitable waterproof gasket materials 7. The top surface of the waterproof gasket material 7 is adhered to the bottom surface portion of the bootie such that the first insole material 5 and at least a portion of the perimeter edge portion of the laminate liner material 1 are covered by the top surface of the waterproof gasket material 7, thus forming a waterproof bootie. The waterproof gasket material 7 can be adhered to the bottom surface portion of the bootie using any suitable adhesive material. Non-limiting examples of suitable adhesive materials include, for example, polyurethane, natural latex rubber, nitrile rubber, silicone rubber, butyl rubber, fluorinated rubber, copolyether polyester, polyester, ethylene vinyl acetate or polyamide. In an aspect of the invention, the adhesive is a polyurethane adhesive. The polyurethane adhesive can be a reactive polyurethane which is activated by application of heat thereto. The adhesive can be previously applied to the gasket material 7, or it can be applied by, for example, brushing, etc., at the point of footwear assembly. Moreover, the adhesive can be applied to the bottom surface portion of the bootie, preferably covering substantially the entire bottom surface portion of the bootie. Of course, adhesive may be applied to both the waterproof gasket material 7 and to the bottom surface portion of the bootie.

If a reactive polyurethane adhesive is used, the adhesive can be applied to the surface of the top surface of the waterproof gasket (or to the bottom surface portion of the bootie, or both) and allowed to dry. Thereafter the top surface of the waterproof gasket material 7 and the bottom surface portion of the bootie can be pressed together and heat applied to soften and cause the polyurethane to react and form an adhesive bond between the two surfaces, thus forming a waterproof bootie. In an aspect of the invention, reactive polyurethane could be applied as described above, but rather than allowing the polyurethane to dry, the top surface of the waterproof gasket and the bottom surface portion of the bootie could be immediately pressed together to form the waterproof bootie. In a further aspect of the invention, the waterproof gasket material 7 is a three layer gasket material comprising a woven or nonwoven material having on one surface thereof a stable, non-flowing polymer film (such as polyurethane) with a flowable polymer adhesive applied to the other side of the stable, non-flowing polymer film. Upon application of heat and pressure, the flowable polymer adhesive can bond the waterproof gasket material to the bottom surface of the bootie, while the stable, non-flowing polymer film remains stable under the conditions, thus maintaining waterproofness of the gasket. Such a waterproof gasket could be premanufactured and installed at the point of footwear manufacture, thus eliminating the step of the factory worker applying adhesive to the gasket at the point of footwear assembly.

Figure 5:
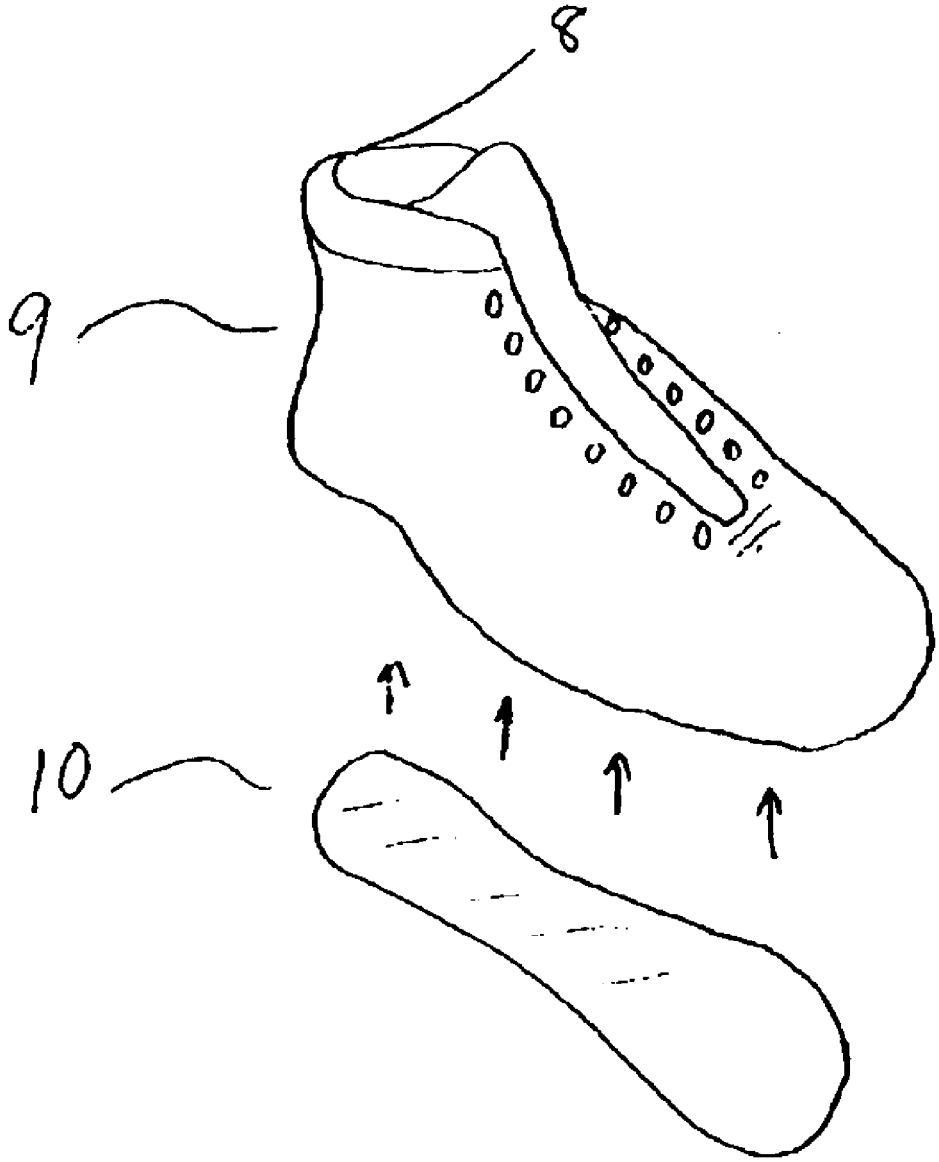
FIG. 5 is a perspective view of a shoe upper and a second insole material before being attached to the shoe upper.

Thereafter, the open top portion 2 of the bootie can be secured to the collar portion 8 of a shoe upper 9, shown in FIG. 5. Any suitable material can be used to form shoe upper 9, such as leather or fabric. Any suitable means can be used for securing the open top portion 2 of the bootie to the collar portion 8 of the shoe upper 9. In an aspect of the invention, the open top portion 2 of the bootie is secured to the collar portion 8 of the shoe upper 9 by stitching. In a further aspect of the invention, the open top portion 2 of the bootie can be secured to the collar portion 8 of the shoe upper 9 before the waterproof gasket material 7 is adhered to the bottom surface portion of the bootie. Then the waterproof gasket can be applied to the bottom of the bootie as discussed above, prior to attachment of the shoe upper 9 to a second insole material.

In any case, once the open top portion 2 of the waterproof bootie has been secured to the collar portion 8 of the shoe upper 9, closing of the shoe upper 9 is performed. Specifically, the waterproof bootie is pulled up into the collar area of the shoe upper 9 so it does not get damaged by the following operation. The perimeter edge portion of the shoe upper 9 is secured to a second insole material to form a closed upper. Securing of the shoe upper 9 to the second insole material can be accomplished by, for example, stapling, stitching, etc. In a preferred embodiment, the closed upper is formed by stitching the perimeter edge portion of the shoe upper to the second insole material. Any suitable material can be used for the second insole material, such as those listed above for the first insole material. Once the closed upper is formed, the waterproof bootie is then pushed back into the closed upper (the use of compressed air is effective for this step). Assembly of the footwear is then completed by manual slip or force lasting. This results in an exceptionally tight fit between the bootie and the closed upper, with the bottom surface of the waterproof gasket material contacting at least a portion of the second insole material.

In an aspect of the invention, suitable adhesive, such as those described above, can be applied to the bottom surface of the waterproof gasket, to the top surface of the second insole material, to the perimeter edge portion of the shoe upper, or to two or more of these surfaces to result in improved adhesion between the waterproof bootie and the closed upper. In any case pressure can be applied to adhere the surfaces together. In a preferred embodiment, the bottom surface of the waterproof gasket material is adhered to the top surface of the second insole material. In an aspect of the invention, the adhesive used can be a heat activated adhesive. More particularly, a reactive polyurethane adhesive can be used. If the adhesive is a heat activated adhesive, then, of course, heat is applied in addition to applying pressure to the waterproof gasket material 7 and the insole board 10. This results in a secure bond between the bootie and the insole board. It should be noted that if an adhesive is used, the bottom surface of the waterproof gasket material may not actually contact the second insole material due to the layer of adhesive material located therebetween. However, as used herein and in the claims when it is stated that the bottom surface of the waterproof gasket material "contacts" at least a portion of the second insole material, this includes the embodiment where a layer of adhesive is located between the surfaces, thus, perhaps, preventing the surfaces from actually contacting each other.

Conventional steps can then be performed to attach a suitable outer sole material to the bottom surface of the footwear.

Figure 6:
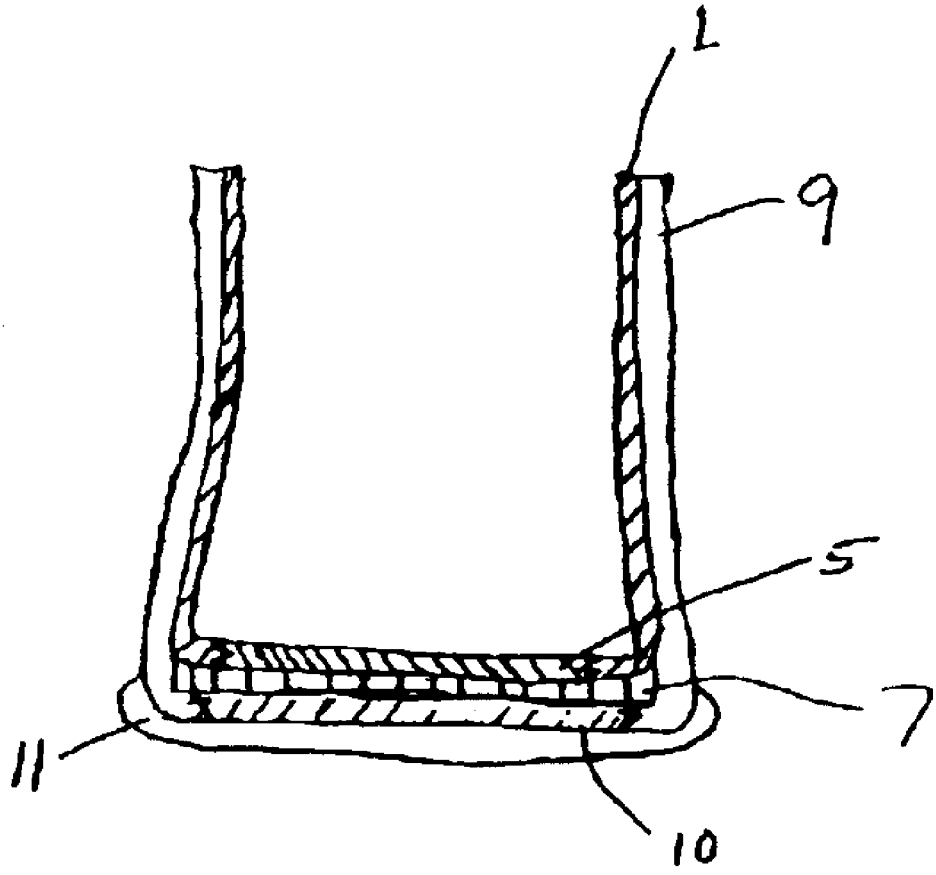
FIG. 6 is a cross-sectional view of a waterproof footwear article of the present invention.

For completeness, FIG. 6 is a cross-sectional view of the footwear according to the invention wherein conventional outer sole is indicated by 11. Outer sole 11 can be any suitable material such as, for example, polyurethane, natural rubber, synthetic rubbers, leather, artificial leather, polyvinyl chloride, ethylene vinyl acetate, etc., and combinations thereof.

What is meant by "waterproof footwear" is determined as follows. The footwear is placed on top of a piece of blotter paper. The inside of the footwear is filled with room temperature water to a height of about 30 mm (measured from the insole at the heel area of the footwear). The water is allowed to stand in the footwear for at least two hours. At the end of the two hour period the blotter paper and footwear upper are examined to determine if water has reached the blotter paper or the outside of the upper. If no water has reached the blotter paper or the outside of the upper, then the footwear is waterproof.

As used herein the "waterproof, water vapor permeable functional layer" and the "waterproof gasket material" are "waterproof" if, when combined to form the footwear according to the invention, they result in the footwear being "waterproof" as defined above.

While particular embodiments of the present invention have been illustrated and described herein, the present invention should not be limited to such illustrations and descriptions. It should be apparent that changes and modifications may be incorporated and embodied as part of the present invention within the scope of the following claims.

What is claimed is:

1. Waterproof footwear comprising:

a laminate liner material including at least a waterproof, water vapor permeable functional layer with an open top portion secured to a collar portion of an upper material, and a bottom perimeter edge portion stitched to a first insole material;

a waterproof gasket material having a top surface and a bottom surface with the top surface adhered to and covering the first insole material and at least a portion of the bottom edge portion of the laminate liner material;

a second insole material stitched to a perimeter edge portion of the upper material, forming a closed upper; and wherein the bottom surface of the waterproof gasket material contacts at least a portion of the second insole material.

2. The footwear of claim 1, wherein the waterproof, water vapor permeable functional layer comprises a polymeric membrane material.

3. The footwear of claim 2, wherein the polymeric membrane material is selected from the group consisting of polyurethane, polyester, polyether, polyamide, polyacrylate, copolyether ester, and copolyether amide.

4. The footwear of claim 2, wherein the laminate liner comprises at least one layer of microporous, expanded polytetrafluoroethylene and at least one layer of textile material.

5. The footwear of claim 2, wherein the polymeric membrane material comprises microporous, expanded polytetrafluoroethylene.

6. The footwear of claim 1, wherein the first insole material comprises a material selected from woven and nonwoven textile materials.

7. The footwear of claim 6, wherein the first insole material comprises a material selected from the group consisting of polyester, nylon, polyacrylic, polyolefin, polyurethane, polyvinyl, cotton, acetate, rayon, olefin, acrylic, wool, spandex, metallic, and combinations thereof.

8. The footwear of claim 1, wherein the waterproof gasket comprises a material selected from the group consisting of polymeric materials, waterproof fabrics, and fabrics coated with polymer.

9. The footwear of claim 8, wherein at least one of the top surface and the bottom surface of the waterproof gasket material has thereon a polyurethane adhesive material.

10. The footwear of claim 9, wherein the polyurethane adhesive material is located on the top surface and the bottom surface of the waterproof gasket material.

11. The footwear of claim 1, wherein adhesive is located between the bottom surface of the waterproof gasket material and the at least a portion of the second insole material.

12. The footwear of claim 1, wherein an outer sole is secured to the footwear.

* * * * *